US007516625B2

(12) United States Patent
Kwon

(10) Patent No.: US 7,516,625 B2
(45) Date of Patent: Apr. 14, 2009

(54) BUILT-IN REFRIGERATOR

(75) Inventor: Yong-Chol Kwon, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 837 days.

(21) Appl. No.: 11/039,899

(22) Filed: Jan. 24, 2005

(65) Prior Publication Data

US 2005/0160746 A1 Jul. 28, 2005

(30) Foreign Application Priority Data

Jan. 28, 2004 (KR) ..... 10-2004-0005450
Jan. 28, 2004 (KR) ..... 10-2004-0005451

(51) Int. Cl.
*F25D 11/00* (2006.01)
*F25D 23/12* (2006.01)
*A47B 96/04* (2006.01)
*A47F 3/04* (2006.01)

(52) U.S. Cl. ..... 62/440; 62/259.1; 312/402; 312/405; 312/116

(58) Field of Classification Search ..... 62/125, 62/440, 441, 448, 449, 259.1; 312/402, 404, 312/405, 204, 116, 138.1
See application file for complete search history.

(56) References Cited

U.S. PATENT DOCUMENTS

2004/0222725 A1 * 11/2004 Park et al. ..... 312/405

FOREIGN PATENT DOCUMENTS

EP 647821 A1 * 4/1995
WO WO 03009723 A1 * 2/2003

* cited by examiner

*Primary Examiner*—Chen-Wen Jiang
(74) *Attorney, Agent, or Firm*—Ked & Associates LLP

(57) ABSTRACT

Disclosed is a built-in refrigerator comprising: a furniture body having a receiving space therein; a furniture door installed at a front side of the furniture body to be opened and closed, and having a through hole at a front surface thereof; a refrigerator body installed in the receiving space of the furniture body; a refrigerator door installed at a front side of the refrigerator body to be opened and closed, and having a display portion for informing an operation state of the refrigerator at a front surface thereof; a bracket installed between the furniture door and the refrigerator door so that the refrigerator door can be opened and closed together with the furniture door at the time of opening and closing the furniture door; and a cover member installed at the through hole of the furniture door.

12 Claims, 9 Drawing Sheets

BUILT-IN REFRIGERATOR

BACKGROUND OF THE INVENTION

1. Field of the Invention

The present invention relates to a built-in refrigerator, and more particularly, to a built-in refrigerator installed in a furniture.

2. Description of the Conventional Art

Generally, a refrigerator is an apparatus for storing food freshly, and is divided into a body having a freezing chamber and a refrigerating chamber therein, and components of a refrigerating cycle installed at the body in order to cool the freezing chamber and the refrigerating chamber.

As a capacity of the refrigerator is increased, when the refrigerator is installed in an indoor room as it is, a fine view of the indoor room may be spoiled, a person's passing may be hindered, and a utilizable space of the indoor room is decreased as much as a volume of the refrigerator.

In order to solve the problems, recently, a research for a built-in refrigerator that a refrigerator is mounted in an indoor furniture is being actively performed.

First of all, a receiving space for receiving a refrigerator is formed in an indoor furniture, and then the built-in refrigerator is mounted in the receiving space. According to this, the built-in refrigerator provides a unity with a peripheral furniture, and a damage thereof due to a scar thereon can be effectively prevented.

FIG. 1 is an entire perspective view showing a built-in refrigerator according to one embodiment of the conventional art, and FIG. 2 is a partial perspective view showing the built-in refrigerator according to one embodiment of the conventional art.

As shown in FIGS. 1 and 2, a built-in refrigerator 10 according to one embodiment of the conventional art comprises: a furniture body 11 having a receiving space 11*a* therein; a furniture door 12 rotatably hinge-coupled to one side of a front surface of the furniture body 11; a refrigerator body 13 mounted in the receiving space 11*a* of the furniture body 11; a refrigerator door 14 rotatably hinge-coupled to one side of a front surface of the refrigerator body 13, and having a display portion 14*b* for informing an operation state of the refrigerator; and a bracket 15 installed between the refrigerator door 14 and the furniture door 12, for opening and closing the refrigerator door 14 together with the furniture door 12.

One side of the bracket 15 is fixed to the furniture door 12 by a bolt 16, and another side of the bracket 15 is connected to the refrigerator door 14 by a guide protrusion 17.

The guide protrusion 17 fitted into an inclined long groove 18 is slid along the inclined long groove 18 when the furniture door 12 and the refrigerator door 14 are opened and closed, so that the furniture door 12 and the refrigerator door 14 are smoothly opened and closed without being interfered with each other.

However, in the conventional built-in refrigerator, since the refrigerator door located in the receiving space of the furniture maintains a blocked state by the furniture door, a user has a difficult in certifying an operation state of the refrigerator.

That is, generally, a display portion is installed outside a refrigerator door in order to display an operation state of a refrigerator. However, since the display portion is always blocked by a furniture door, a user had a difficulty in certifying an operation state of the refrigerator.

FIG. 3 is a perspective view showing a part of a built-in refrigerator according to another embodiment of the conventional art.

As shown in FIG. 3, in a built-in refrigerator 20 according to another embodiment of the conventional art, a display portion 24*b* formed at a front surface of a refrigerator door 24 is exposed to outside of a furniture door 22, and a through hole 22*a* is formed at a front surface of the furniture door 22 so that a user can certify an operation state of the refrigerator by viewing the display portion 24*b*.

However, in the built-in refrigerator 20 according to another embodiment of the conventional art, since the through hole is exposed to outside of the furniture door, the beauty on appearance of the furniture is spoiled and foreign materials such as dust, etc. are introduced into the furniture.

SUMMARY OF THE INVENTION

Therefore, an object of the present invention is to provide a built-in refrigerator capable of easily certifying an operation state thereof by a user through a display portion exposed to outside of a furniture door.

Another object of the present invention is to provide a built-in refrigerator capable of maintaining cleanliness by preventing foreign materials such as dust from being introduced into a furniture door via the through hole formed at the furniture door.

To achieve these and other advantages and in accordance with the purpose of the present invention, as embodied and broadly described herein, there is provided a built-in refrigerator according to a first embodiment comprising: a furniture body having a receiving space therein; a furniture door installed at a front side of the furniture body to be opened and closed, and having a through hole at a front surface thereof; a refrigerator body installed in the receiving space of the furniture body; a refrigerator door installed at a front side of the refrigerator body, and having a display portion for informing an operation state of the refrigerator at a front surface thereof; a bracket installed between the furniture door and the refrigerator door so that the refrigerator door can be opened and closed together with the furniture door at the time of opening and closing the furniture door; and a cover member installed at the through hole of the furniture door.

The cover member is composed of: a window portion corresponding to the display portion and formed of a transparent material; and a flange portion curvedly formed from the window portion and inserted into the through hole thereby to be locked at a front surface of the furniture door.

Preferably, a plurality of stepping protrusions are formed at an outer surface of the window portion and locked at a rear surface of the furniture door.

In a built-in refrigerator according to a second embodiment of the present invention, an inclination surface gradually inclined towards the window portion is formed at the flange portion.

A built-in refrigerator according to a third embodiment of the present invention comprises: a furniture body having a receiving space therein; a furniture door installed at a front side of the furniture body to be opened and closed, and having a through hole at a front surface thereof; a refrigerator body installed in the receiving space of the furniture body; a refrigerator door installed at a front side of the refrigerator body to be opened and closed, and having a connection groove at a front surface thereof; a bracket installed between the furniture door and the refrigerator door so that the refrigerator door can be opened and closed together with the furniture door at the time of opening and closing the furniture door; a display member installed at the through hole of the furniture door, for informing an operation state of the refrigerator; a first connector installed in the connection groove of the refrigerator door; and a second connector installed at the display member and connected to the first connector.

The display member is composed of: a liquid crystal portion inserted into the through hole of the furniture door; a flange portion for fixing the liquid crystal portion to the furniture door; and an adjustment button for operating the refrigerator.

A built-in refrigerator according to a fourth embodiment of the present invention comprises: a furniture body having a receiving space therein; a furniture door installed at a front side of the furniture body to be opened and closed, and having a through hole at a front surface thereof; a refrigerator body installed in the receiving space of the furniture body; a refrigerator door installed at a front side of the refrigerator body to be opened and closed, and having a mounting groove at a front surface thereof; a bracket installed between the furniture door and the refrigerator door so that the refrigerator door can be opened and closed together with the furniture door at the time of opening and closing the furniture door; a first display portion installed at the mounting groove of the refrigerator door, for informing an operation state of the refrigerator; a first connector electrically connected to the first display portion; a second display portion installed at the through hole of the furniture door; and a second connector electrically connected to the second display portion, and selectively coupled to the first connector.

The second display portion is composed of: a liquid crystal portion inserted into the through hole of the furniture door; and a flange portion for fixing the liquid crystal portion to the furniture door.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
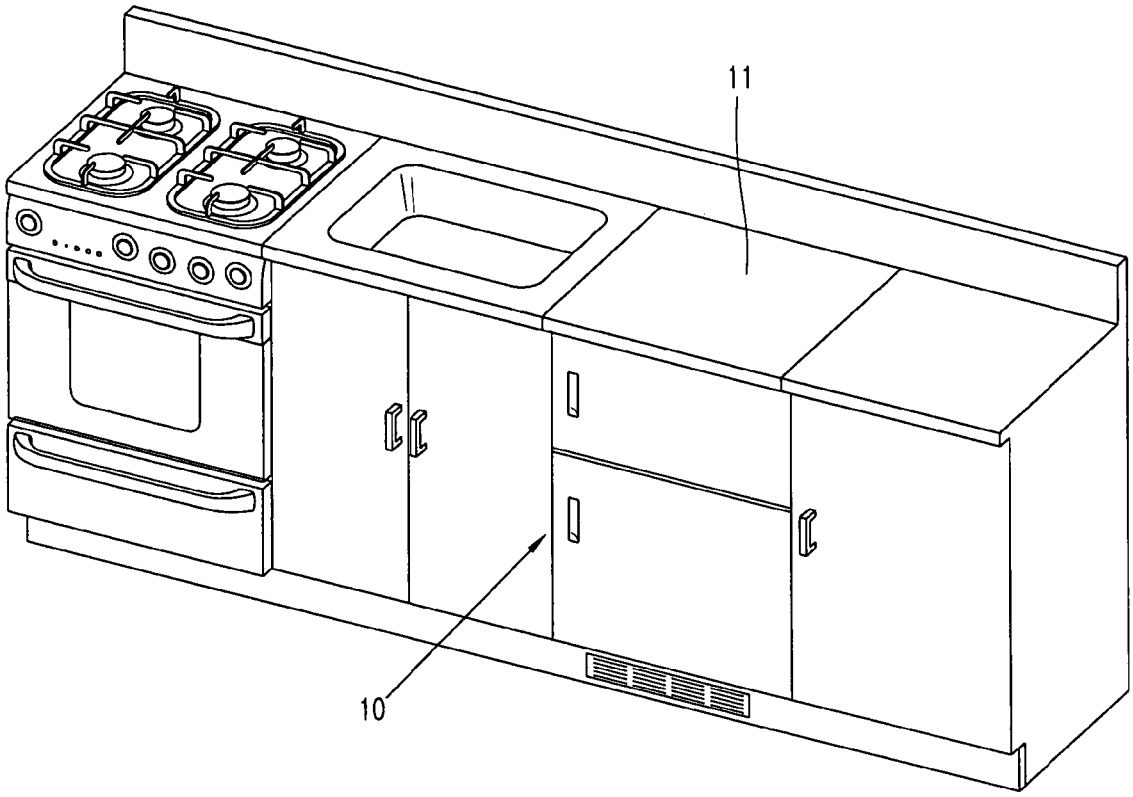
FIG. 1 CONVENTIONAL ART
FIG. 1 is an entire perspective view showing a built-in refrigerator according to one embodiment of the conventional art.
Figure 2:
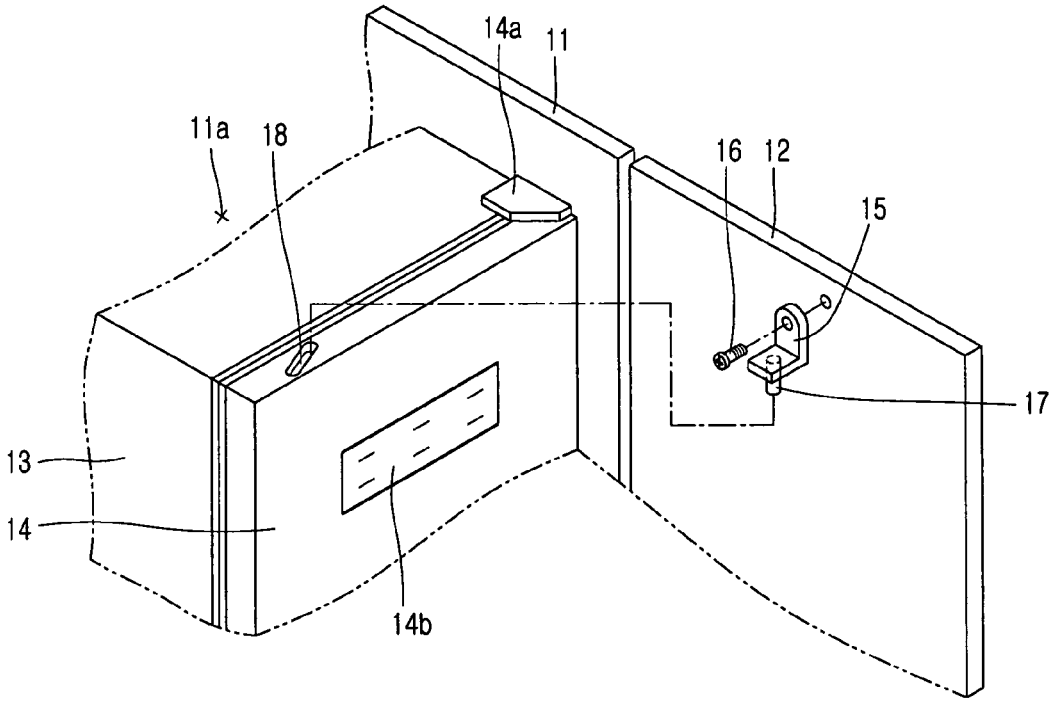
FIG. 2 CONVENTIONAL ART
FIG. 2 is a partial perspective view showing the built-in refrigerator according to one embodiment of the conventional art.
Figure 3:
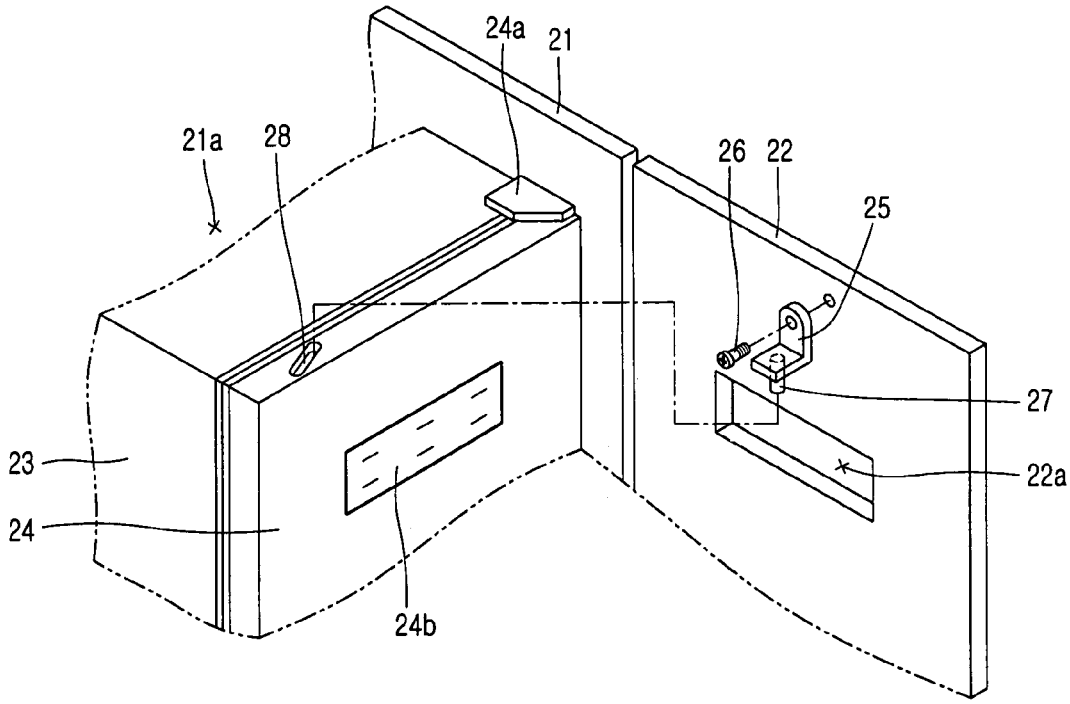
FIG. 3 CONVENTIONAL ART
FIG. 3 is a partial perspective view showing a built-in refrigerator according to another embodiment of the conventional art.
Figure 4:
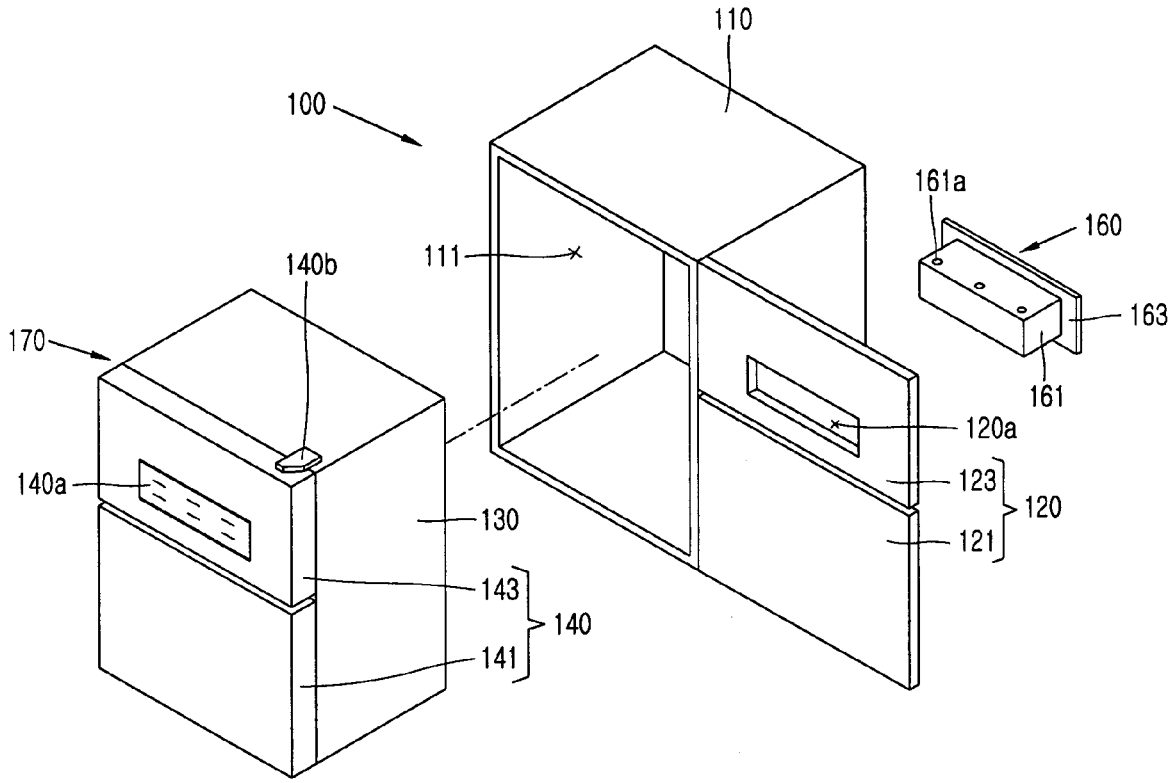
FIG. 4 is a disassembled perspective view showing a built-in refrigerator according to one embodiment of the present invention.
Figure 5:
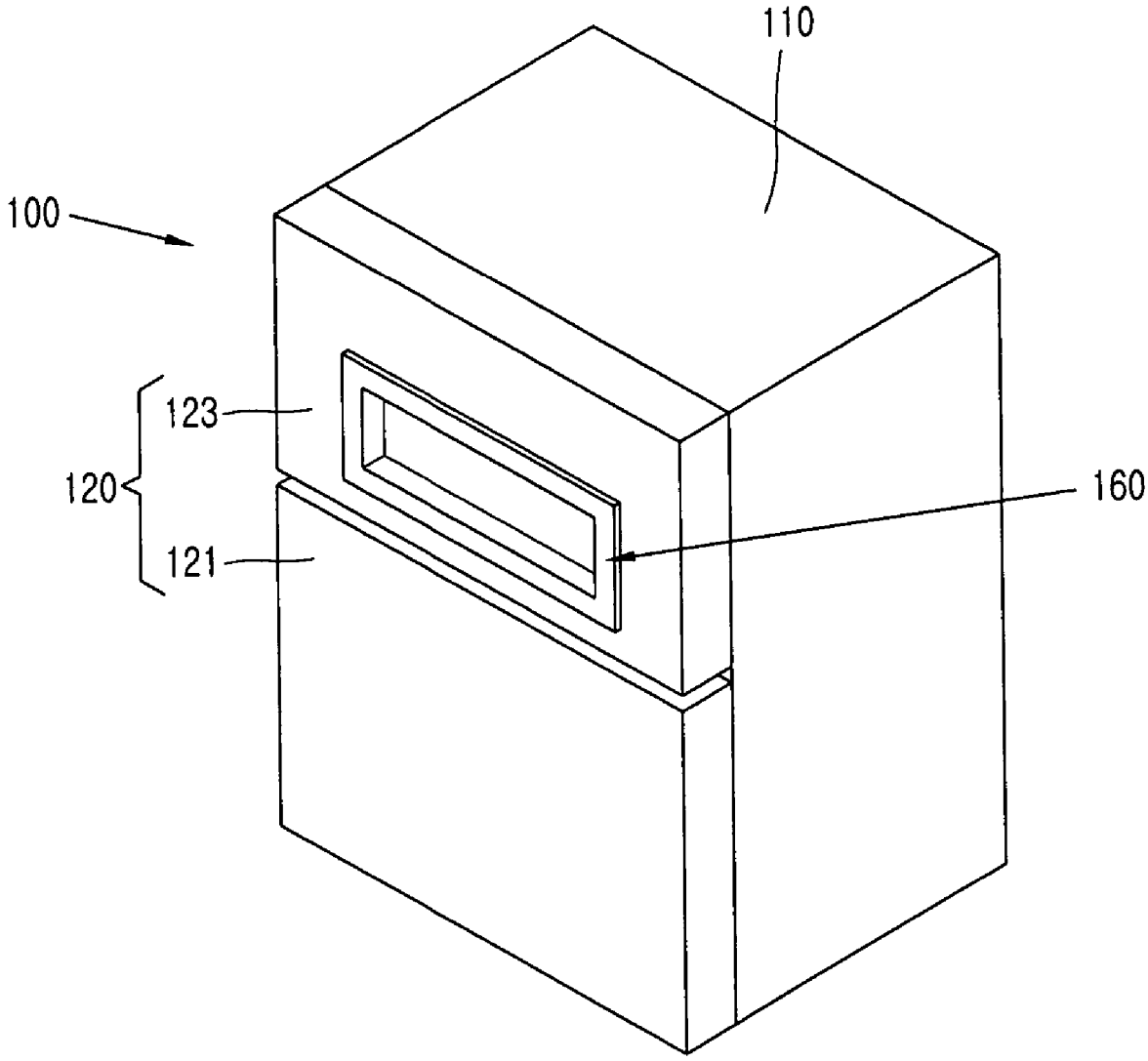
FIG. 5 is an assembled perspective view showing the built-in refrigerator according to one embodiment of the present invention.
Figure 6:
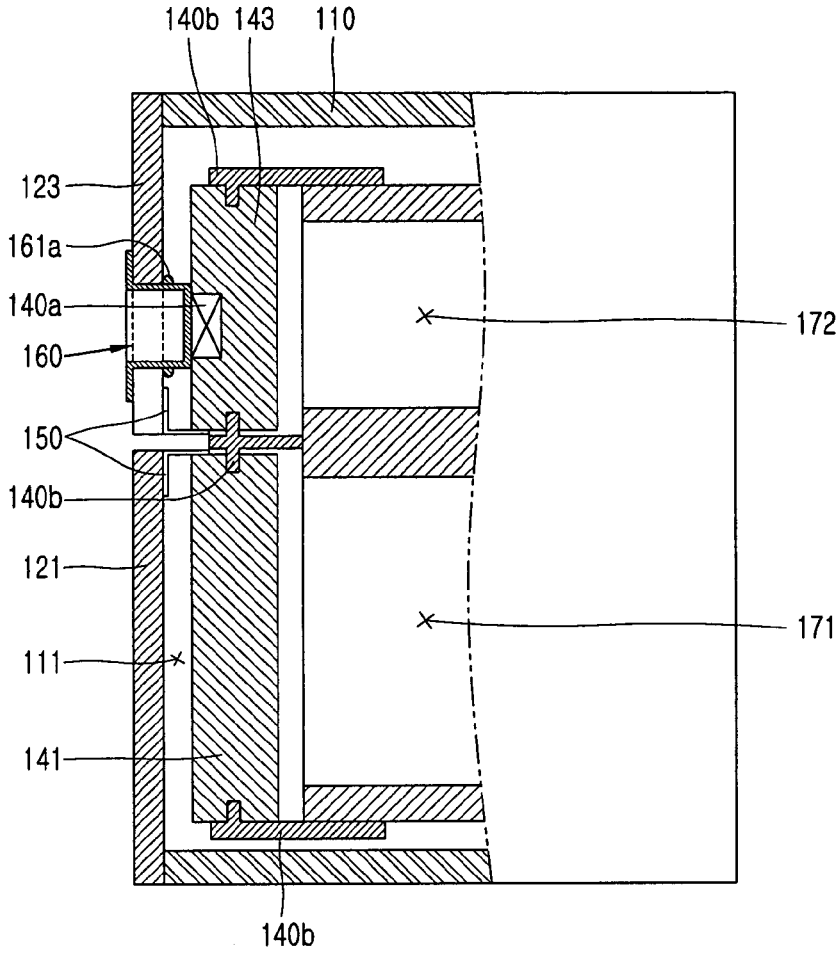
FIG. 6 is a longitudinal section view showing the built-in refrigerator according to one embodiment of the present invention.

FIG. 4 is a disassembled perspective view showing a built-in refrigerator according to one embodiment of the present invention, FIG. 5 is an assembled perspective view showing the built-in refrigerator according to one embodiment of the present invention, and FIG. 6 is a longitudinal section view showing the built-in refrigerator according to one embodiment of the present invention.

As shown, a built-in refrigerator 100 according to one embodiment of the present invention comprises: a furniture body 110 having a receiving space 111 therein; a furniture door 120 installed at a front side of the furniture body 110 to be opened and closed, and having a through hole 120*a* at a front surface thereof; a refrigerator body 130 installed in the receiving space 111 of the furniture body 110; a refrigerator door 140 installed at a front side of the refrigerator body 130 to be opened and closed, and having a display portion 140*a* for informing an operation state of the refrigerator at a front surface thereof; a bracket 150 installed between the furniture door 120 and the refrigerator door 140 so that the refrigerator door 140 can be opened and closed together with the furniture door 120 at the time of opening and closing the furniture door 120; and a cover member 160 installed at the through hole 120*a* of the furniture door 120.

The receiving space 111 is formed in the furniture body 110, and the furniture door 120 is rotatably hinge-coupled to a front side of the furniture body 110. A refrigerator 170 is accommodated in the receiving space 111.

The refrigerator 170 is composed of: the refrigerator body 130; and the refrigerator door 140 rotatably installed at a front side of the refrigerator body 130 by a hinge 140*b*.

The refrigerator door 140 is composed of: a lower refrigerator door 141 positioned at a side of a cooling chamber 171; and an upper refrigerator door 143 positioned at a freezing chamber 172. According to this, the furniture door 120 is also composed of: a lower furniture door 121 positioned at the cooling chamber 171; and an upper furniture door 123 positioned at the freezing chamber 172.

Brackets 150 are installed between the furniture door 120 and the refrigerator door 140 so that the refrigerator door 140 can be opened and closed together with the furniture door 120 at the time of opening and closing the furniture door 120.

The brackets 150 have a general structure, thereby omitting details of the structure.

The cover member 160 is fitted into the through hole 120*a* of the furniture door 120, and prevents foreign materials such as dust, etc. from being introduced into the furniture door 120 via the through hole 120*a*.

The cover member 160 is composed of: a window portion 161 corresponding to the display portion 140*a* and formed of a transparent material; and a flange portion 163 curvedly formed from the window portion 161 and inserted into the through hole 120*a* thereby to be locked at a front surface of the furniture door 120.

Preferably, the window portion 161 is adhered to the display portion 140*a* so that a user can easily certify the display portion 140*a*. Generally, the display portion 140*a* for displaying an inner temperature of the refrigerator, etc. is formed of a liquid crystal monitor, an LED, etc.

Preferably, a plurality of stepping protrusions 161*a* are formed at an outer surface of the window portion 161 and locked at a rear surface of the furniture door 120. According to this, the cover member 160 is firmly fixed to the through hole 120*a* by the flange portion 163 and the plurality of stepping protrusions 161*a*.

The stepping protrusion 161*a* is preferably formed of an elastic material for an easy assembly.

An operation of the built-in refrigerator according to the first embodiment of the present invention will be explained as follows.

As shown in FIGS. 4 to 6, in a built-in refrigerator 100 according to the first embodiment of the present invention, the furniture door 120 and the refrigerator door 140 are rotatably opened and closed by a hinge (not shown) of the furniture door 120 and the hinge 140*b* of the refrigerator door 140 when a user opens and closes the furniture door 120.

When the furniture door 120 is opened and closed, the refrigerator door 140 is also opened and closed together with the furniture door 120 by the bracket 150 installed between the furniture door 120 and the refrigerator door 140.

Since the cover member 160 is installed at the through hole 120*a* of the furniture door 120 and the window portion 161 is adhered to the display portion 140*a*, the display portion 140*a* formed of a transparent material can be seen from outside of the furniture door 120 through the transparent window portion 161. According to this, the user can easily certify an operation state of the refrigerator through the window portion 161.

Also, since the cover member 160 is installed at the through hole 120*a* of the furniture door 120, foreign materials such as dust, etc. are prevented from being introduced into the furniture door 120 via the through hole 120*a*.

Figure 7:
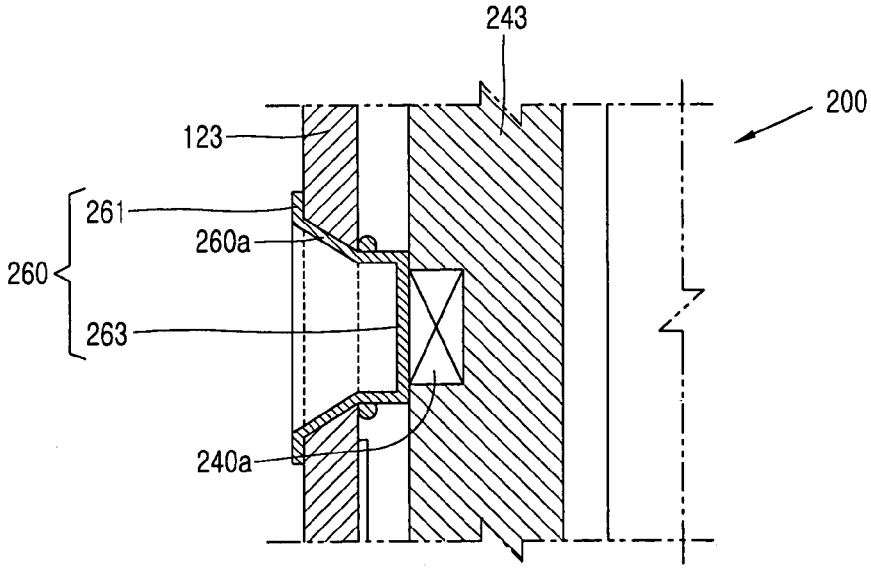
FIG. 7 is a longitudinal section view showing a built-in refrigerator according to a second embodiment of the present invention.

FIG. 7 is a longitudinal section view showing a built-in refrigerator according to a second embodiment of the present invention.

As shown in FIG. 7, in a built-in refrigerator 200 according to the second embodiment of the present invention, an inclination surface 260*a* gradually inclined towards a window portion 263 from a flange portion 261 is formed at the flange portion 261 of a cover member 260. The inclination surface 260*a* is formed so that the user can easily certify the display portion 140*a*. Unexplained reference numerals 223, 240*a*, and 243 respectively denote a furniture door, a display portion, and a refrigerator door.

An operation of the built-in refrigerator 200 according to the second embodiment of the present invention is almost the same as that of the built-in refrigerator 100 according to the first embodiment of the present invention except that a user's viewing angle becomes wider by the inclination surface 260*a* and thereby the user can easily certify the display portion 240*a*.

Figure 8:
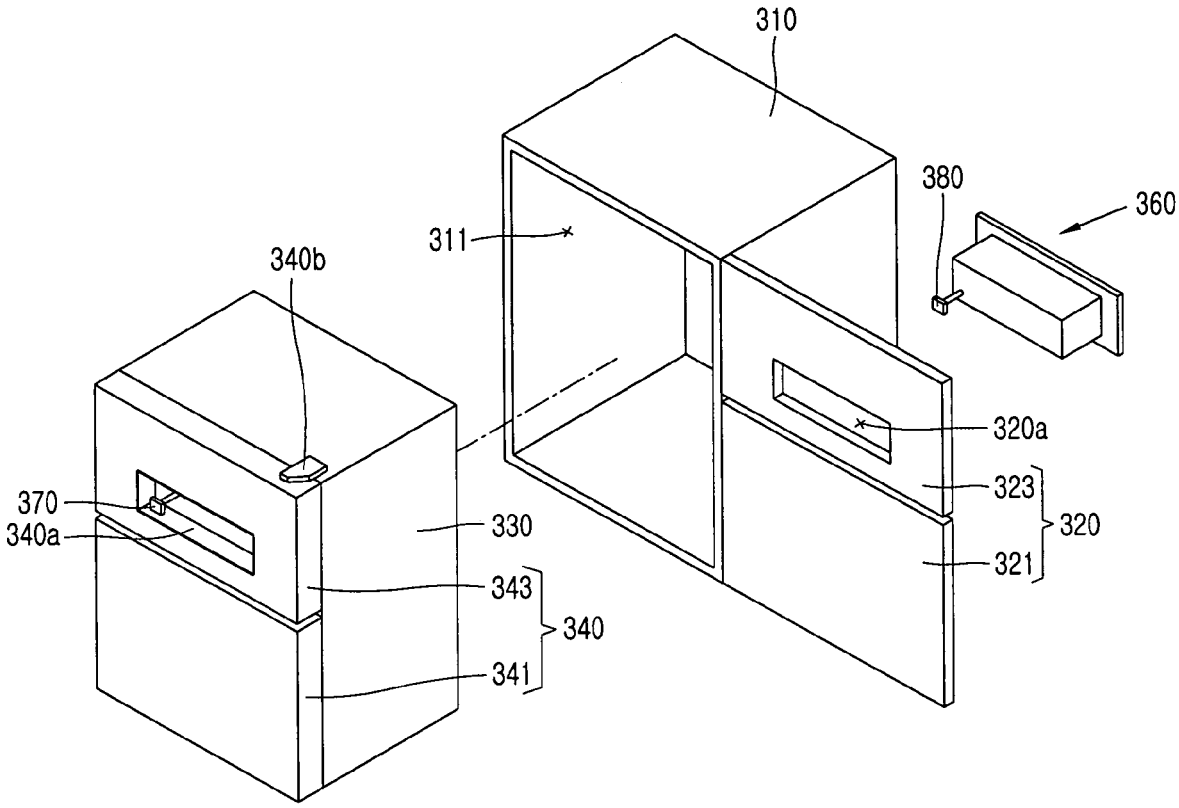
FIG. 8 is a disassembled perspective view showing a built-in refrigerator according to a third embodiment of the present invention.
Figure 9:
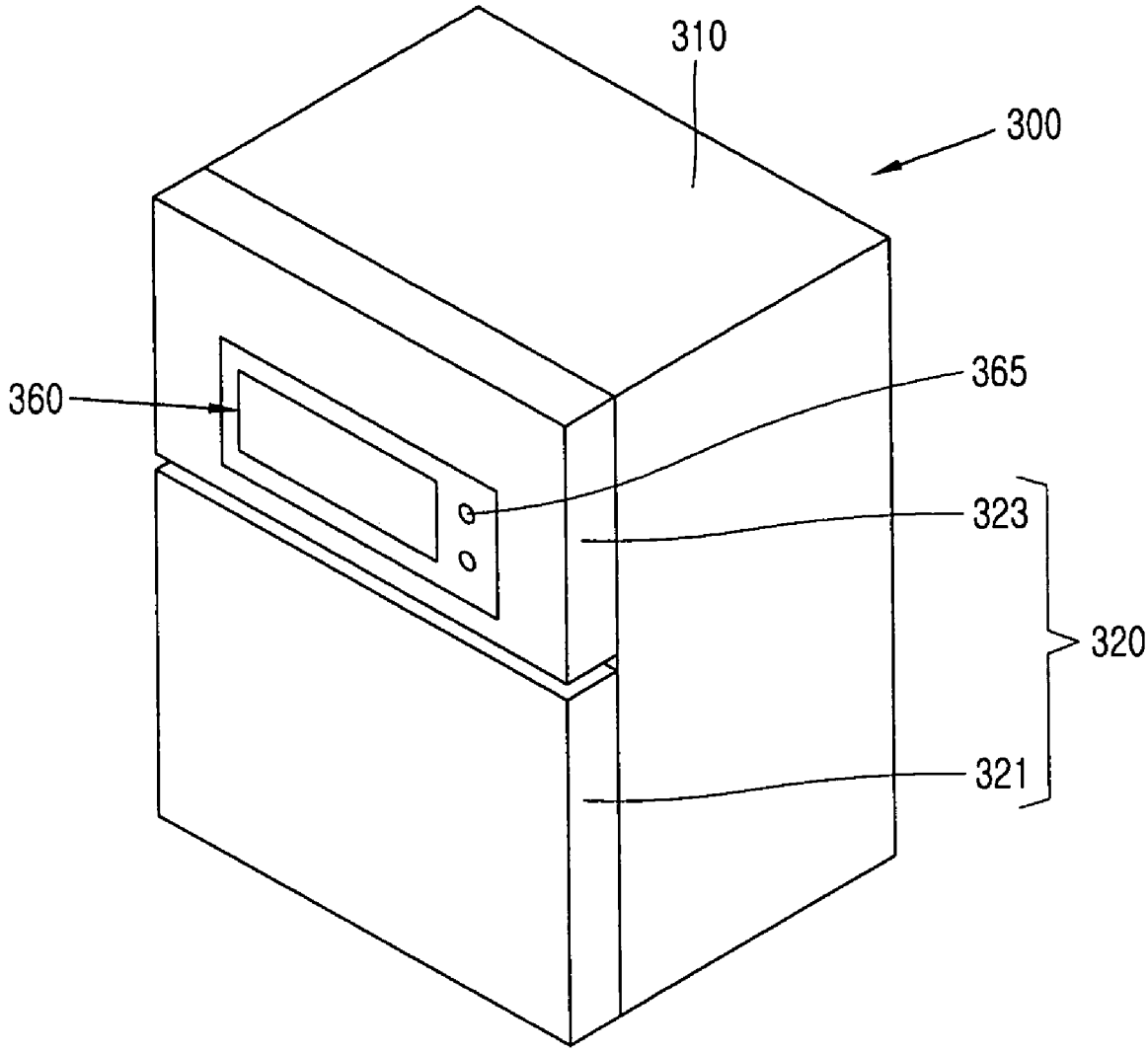
FIG. 9 is an assembled perspective view showing the built-in refrigerator according to the third embodiment of the present invention.
Figure 10:
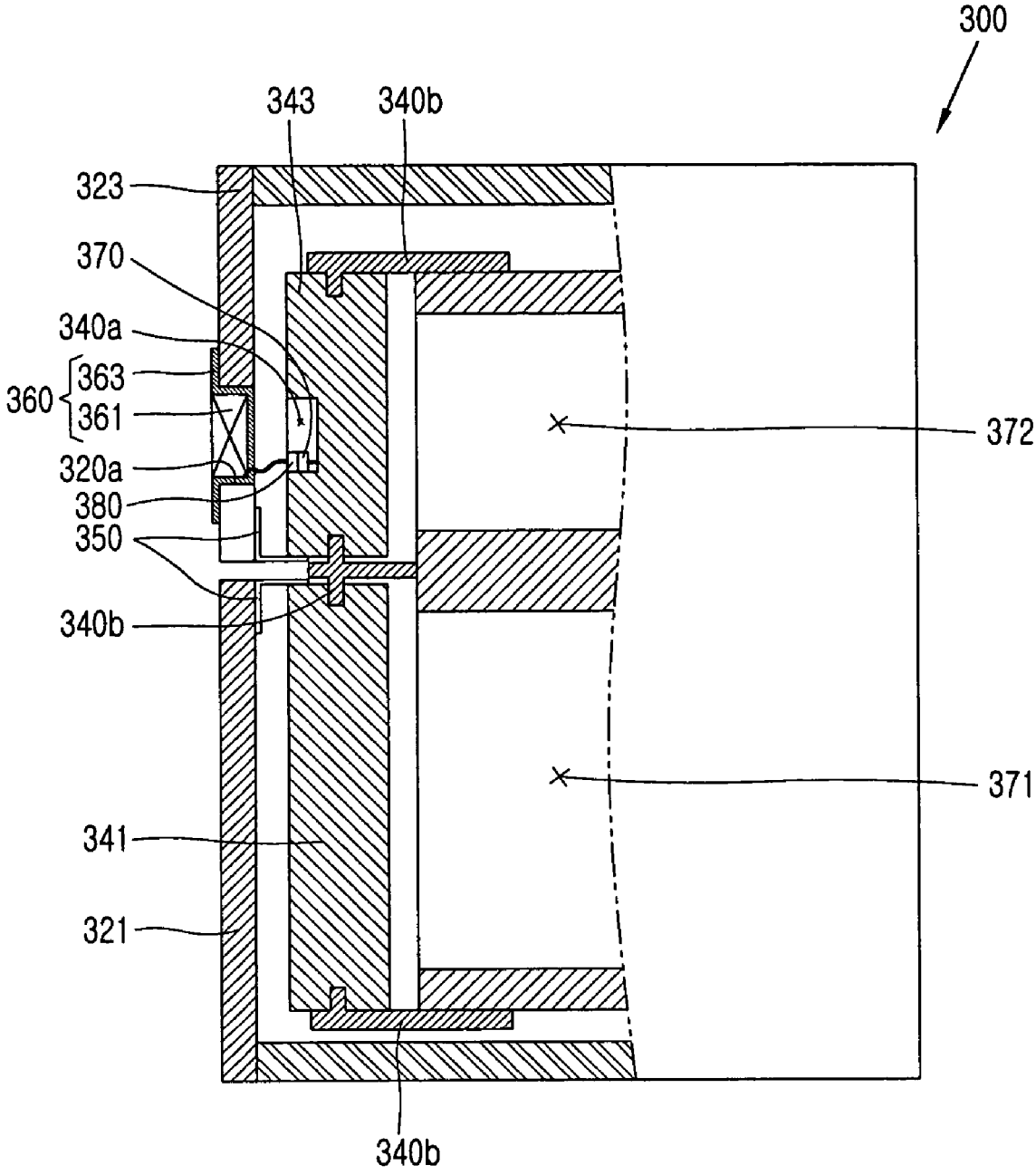
FIG. 10 is a longitudinal section view showing the built-in refrigerator according to the third embodiment of the present invention.

FIG. 8 is a disassembled perspective view showing a built-in refrigerator according to a third embodiment of the present invention, FIG. 9 is an assembled perspective view showing the built-in refrigerator according to the third embodiment of the present invention, and FIG. 10 is a longitudinal section view showing the built-in refrigerator according to the third embodiment of the present invention.

As shown in FIGS, a built-in refrigerator 300 according to the third embodiment of the present invention comprises: a furniture body 310 having a receiving space 311 therein; a furniture door 320 installed at a front side of the furniture body 310 to be opened and closed, and having a through hole 320*a* at a front surface thereof; a refrigerator body 330 installed in the receiving space 311 of the furniture body 310; a refrigerator door 340 installed at a front side of the refrigerator body 330 to be opened and closed, and having a connection groove 340*a* at a front surface thereof; a bracket 350 installed between the furniture door 320 and the refrigerator door 340 so that the refrigerator door 340 can be opened and closed together with the furniture door 320 at the time of opening and closing the furniture door 320; a display member 360 installed at the through hole 320*a* of the furniture door 320, for informing an operation state of the refrigerator; a first connector 370 installed in the connection groove 340*a* of the refrigerator door 340; and a second connector 380 installed at the display member 360 and connected to the first connector 370.

The display member 360 is composed of: a liquid crystal portion 361 inserted into the through hole 320*a* of the furniture door 320; a flange portion 363 for fixing the liquid crystal portion 361 to the furniture door 320; and an adjustment button for operating the refrigerator.

The refrigerator is composed of: the refrigerator body 330; and the refrigerator door 340 rotatably installed at a front side of the refrigerator body 330 by a hinge 340*b*.

The refrigerator door 340 is composed of: a lower refrigerator door 341 positioned at a side of a cooling chamber 371; and an upper refrigerator door 343 positioned at a freezing chamber 372. According to this, the furniture door 320 is also composed of: a lower furniture door 321 positioned at the cooling chamber 371; and an upper furniture door 323 positioned at the freezing chamber 372.

Brackets 350 are installed between the furniture door 320 and the refrigerator door 340 so that the refrigerator door 340 can be opened and closed together with the furniture door 320 at the time of opening and closing the furniture door 320.

The brackets 350 have a general structure, thereby omitting details of the structure.

The cover member 360 is fitted into the through hole 320*a* of the furniture door 320, and prevents foreign materials such as dust, etc. from being introduced into the furniture door 320 via the through hole 320*a*.

The first connector 370 installed in the connection groove 340*a* of the refrigerator door 340 is connected to the second connector 380 connected to the cover member 360. According to this, an operation state of the refrigerator is displayed on the display member 360, and the user can certify the operation state of the refrigerator.

Figure 11:
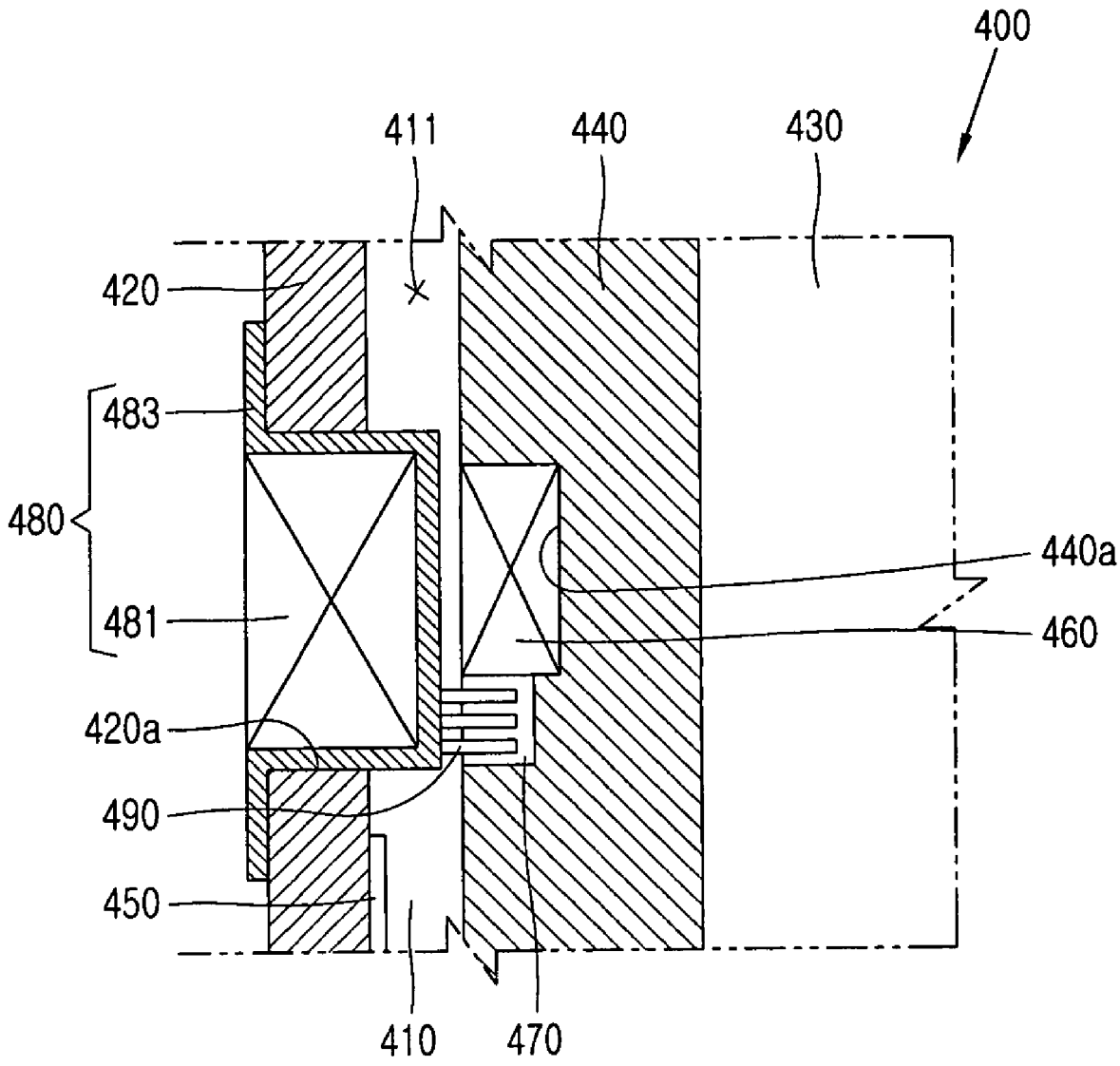
FIG. 11 is a longitudinal section view showing a built-in refrigerator according to a fourth embodiment of the present invention.

FIG. 11 is a longitudinal section view showing a built-in refrigerator according to a fourth embodiment of the present invention.

As shown in FIG. 11, a built-in refrigerator 400 according to a fourth embodiment of the present invention comprises: a furniture body 410 having a receiving space 411 therein; a furniture door 420 installed at a front side of the furniture body 410 to be opened and closed, and having a through hole 421 at a front surface thereof; a refrigerator body 430 installed in the receiving space 411 of the furniture body 410; a refrigerator door 440 installed at a front side of the refrigerator body 430 to be opened and closed, and having a mounting groove 440*a* at a front surface thereof; a bracket 450 installed between the furniture door 420 and the refrigerator door 440 so that the refrigerator door 440 can be opened and closed together with the furniture door 420 at the time of opening and closing the furniture door 420; a first display portion 460 installed at the mounting groove 440*a* of the refrigerator door 440, for informing an operation state of the refrigerator; a first connector 470 electrically connected to the first display portion 460; a second display portion 480 installed at the through hole 420*a* of the furniture door 420; and a second connector 490 electrically connected to the second display portion 480, and selectively coupled to the first connector 470.

The second display portion 480 is composed of: a liquid crystal portion 481 inserted into the through hole 420*a* of the furniture door 420; and a flange portion 482 for fixing the liquid crystal portion 481 to the furniture door 420.

In the built-in refrigerator 400 according to the fourth embodiment of the present invention, the second display portion 480 is fitted into the through hole 420*a* of the furniture door 420, and prevents foreign materials such as dust, etc. from being introduced into the furniture door 420 via the through hole 420*a*.

An operation state of the refrigerator is displayed on the liquid crystal portion 481 of the second display member 480 by the connection between the first connector 470 and the second connector 490, and the user can easily certify the operation state of the refrigerator.

As aforementioned, in the present invention, since the cover member formed of a transparent material is installed at the through hole of the furniture door, the user can easily certify the operation state of the refrigerator by viewing the display portion installed at the front surface of the refrigerator door through the cover member.

Also, since the display member and the adjustment button are installed at the through hole of the furniture door, the user can easily certify the operation state of the refrigerator by viewing the display member.

Additionally, since the cover member and the display member are installed in the through hole of the furniture door, foreign materials such as dust, etc. are prevented from being introduced into the furniture door via the through hole. According to this, cleanliness can be always maintained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A built-in refrigerator comprising:

a furniture body having a receiving space therein;

a furniture door installed at a front side of the furniture body to be opened and closed, and having a through hole at a front surface thereof;

a refrigerator body installed in the receiving space of the furniture body;

a refrigerator door installed at a front side of the refrigerator body to be opened and closed, and having a display portion for informing an operation state of the refrigerator at a front surface thereof;

a bracket installed between the furniture door and the refrigerator door so that the refrigerator door can be opened and closed together with the furniture door at the time of opening and closing the furniture door; and a cover member installed at the through hole of the furniture door.

2. The built-in refrigerator of claim 1, wherein the cover member includes:

a window portion corresponding to the display portion and formed of a transparent material; and a flange portion curvedly formed from the window portion and inserted into the through hole thereby to be locked at a front surface of the furniture door.

3. The built-in refrigerator of claim 2, wherein a plurality of stepping protrusions are formed at an outer surface of the window portion and locked at a rear surface of the furniture door.

4. The built-in refrigerator of claim 2, wherein the window portion is adhered to the display portion.

5. The built-in refrigerator of claim 2, wherein an inclination surface gradually inclined towards the window portion from the flange portion is formed at the flange portion of the cover member.

6. A built-in refrigerator comprising:

a furniture body having a receiving space therein;

a furniture door installed at a front side of the furniture body to be opened and closed, and having a through hole at a front surface thereof;

a refrigerator body installed in the receiving space of the furniture body;

a refrigerator door installed at a front side of the refrigerator body to be opened and closed, and having a connection groove at a front surface thereof;

a bracket installed between the furniture door and the refrigerator door so that the refrigerator door can be opened and closed together with the furniture door at the time of opening and closing the furniture door;

a display member installed at the through hole of the furniture door, for informing an operation state of the refrigerator;

a first connector installed in the connection groove of the refrigerator door; and a second connector installed at the display member and connected to the first connector.

7. The built-in refrigerator of claim 6, wherein the display member includes:

a liquid crystal portion inserted into the through hole of the furniture door;

a flange portion for fixing the liquid crystal portion to the furniture door; and an adjustment button for operating the refrigerator.

8. A built-in refrigerator comprising:

a furniture body having a receiving space therein;

a furniture door installed at a front side of the furniture body to be opened and closed, and having a through hole at a front surface thereof;

a refrigerator body installed in the receiving space of the furniture body;

a refrigerator door installed at a front side of the refrigerator body to be opened and closed, and having a mounting groove at a front surface thereof;

a bracket installed between the furniture door and the refrigerator door so that the refrigerator door can be opened and closed together with the furniture door at the time of opening and closing the furniture door;

a first display portion installed at the mounting groove of the refrigerator door, for informing an operation state of the refrigerator;

a first connector electrically connected to the first display portion;

a second display portion installed at the through hole of the furniture door; and a second connector electrically connected to the second display portion, and selectively coupled to the first connector.

9. The built-in refrigerator of claim 8, wherein the second display portion includes:

a liquid crystal portion inserted into the through hole of the furniture door; and a flange portion for fixing the liquid crystal portion to the furniture door.

10. A built-in refrigerator comprising:

a display member installed at a through hole of a furniture door, for informing an operation state of the refrigerator;

a first connector installed in a connection groove of a refrigerator door; and a second connector installed at the display member and connected to the first connector.

11. The built-in refrigerator of claim 10, wherein the display member includes:

a liquid crystal portion inserted into the through hole of the furniture door; and a flange portion for fixing the liquid crystal portion to the furniture door.

12. A built-in refrigerator comprising:

a first display portion installed at a mounting groove of a refrigerator door, for informing an operation state of the refrigerator;

a first connector electrically connected to the first display portion;

a second display portion installed at a through hole of a furniture door; and a second connector electrically connected to the second display portion and selectively coupled to the first connector.

* * * * *